US007735181B1

(12) United States Patent
Thomas

(10) Patent No.: US 7,735,181 B1
(45) Date of Patent: Jun. 15, 2010

(54) DUSTER FOR BLINDS AND PLANTATION SHUTTERS

(76) Inventor: Brett Lowell Thomas, 239 Brookbend Dr., Waxahachie, TX (US) 75165

( * ) Notice: Subject to any disclaimer, the term of this patent is extended or adjusted under 35 U.S.C. 154(b) by 0 days.

(21) Appl. No.: 12/288,758

(22) Filed: Oct. 23, 2008

Related U.S. Application Data

(60) Provisional application No. 61/000,266, filed on Oct. 24, 2007.

(51) Int. Cl.
*A47L 4/02* (2006.01)

(52) U.S. Cl. ..... 15/220.3; 15/230.11

(58) Field of Classification Search ..... 15/27, 15/220.3, 230.11
See application file for complete search history.

(56) References Cited

U.S. PATENT DOCUMENTS 2,134,965 A * 11/1938 Zbarsky ..... 15/220.3
2,172,479 A * 9/1939 McMillen ..... 15/220.3
2,276,264 A * 3/1942 Goldfinger ..... 15/220.3
2,896,243 A * 7/1959 Schoenfield et al. ..... 15/244.2
4,435,874 A * 3/1984 Jacobson ..... 15/220.3
4,483,037 A * 11/1984 Jacobson ..... 15/220.3
4,574,415 A * 3/1986 Vitonis ..... 15/114
4,879,782 A * 11/1989 Jacobson ..... 15/220.3

* cited by examiner

*Primary Examiner*—Mark Spisich
(74) *Attorney, Agent, or Firm*—Jeffrey Roddy

(57) ABSTRACT

An improved duster for venetian blinds and plantation shutters is disclosed including a handle and cross member with a number of rigid repositionable pins about which a dusting finger freely rotates when drawn lengthwise between the slats of blinds. The process of rotating prevents the bunching of dust unevenly on the dusting finger and provides for a greater removal of dust from the blinds, the dust being evenly distributed about the dusting finger. The dusting fingers may be treated with an anti-static compound to ease intermittent clearing of the dusting finger of dust.

3 Claims, 3 Drawing Sheets

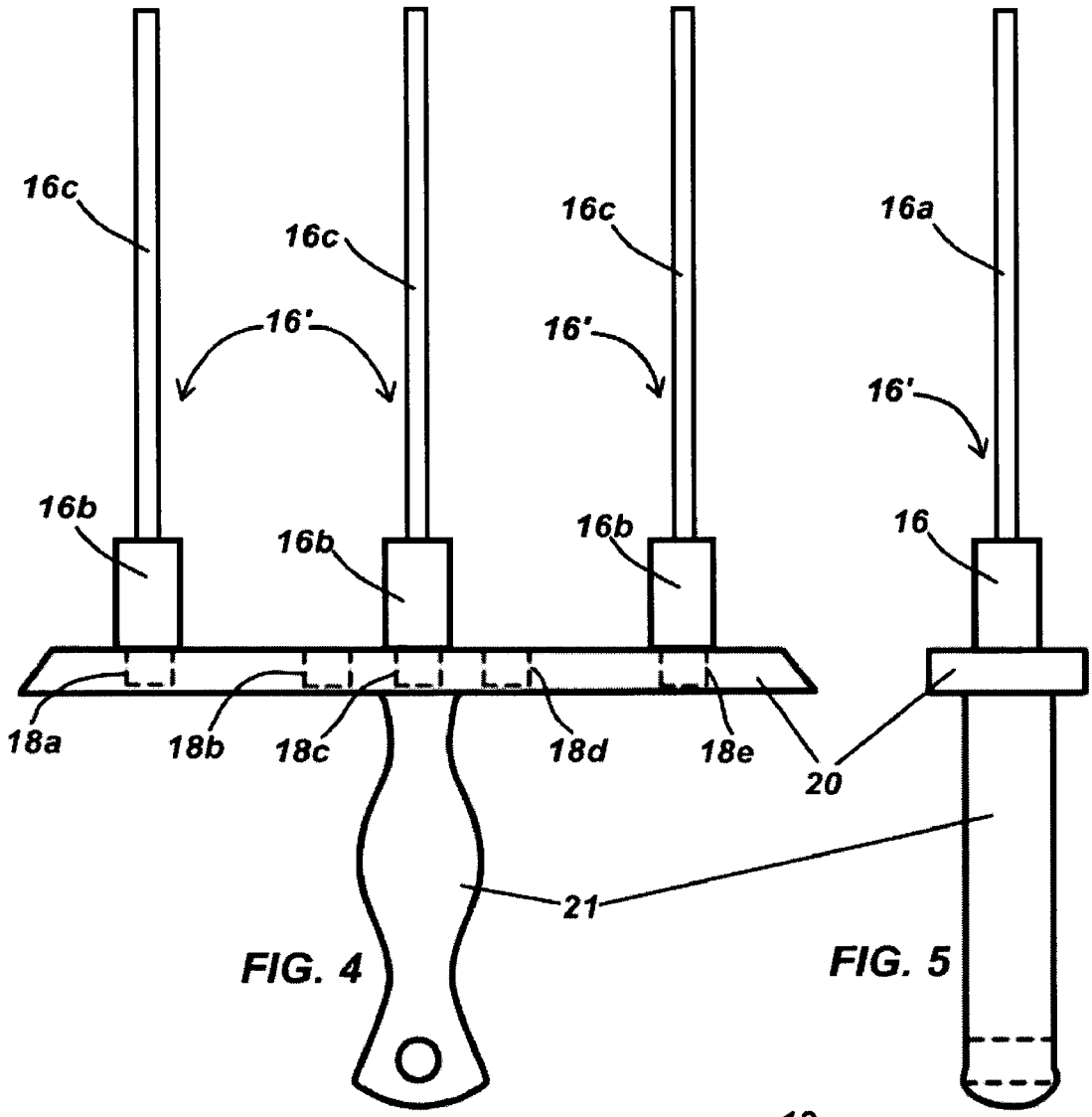
FIG. 4
FIG. 5
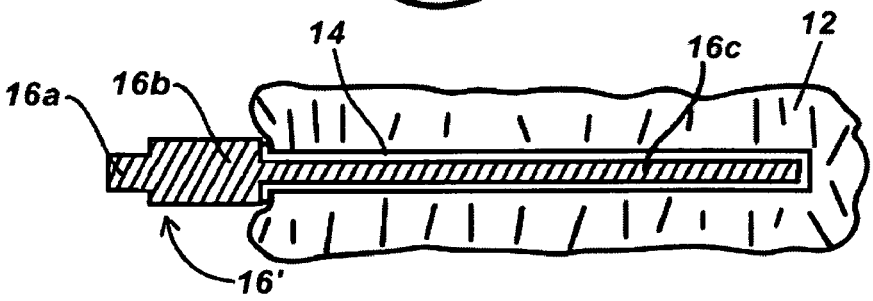
FIG. 6

DUSTER FOR BLINDS AND PLANTATION SHUTTERS

CROSS REFERENCE TO RELATED APPLICATIONS

This application claims the benefit of U.S. Provisional Application No. 61/000,266 filed Oct. 24, 2007 Titled: Duster for venetian blinds

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND

Wood, wood composite and vinyl venetian blinds as well as plantation shutters are gaining in popularity especially for use in upscale homes and offices. While attractive, blinds tend to collect dust and cleaning can be cost prohibitive. Various designs adapted for the removal of dust from venetian blinds are well known in the art, most having fixed dust collecting fingers affixed to a frame. Customarily these "fingers" are passed between the slats of a venetian blind to first attract and then carry off dust. Although the extant devices directed to dusting blinds work, their use is a time consuming process because the duster's fingers have to be cleaned frequently as dust tends to bunch against the fingers on one side. If the dust is not frequently removed from the fingers, it will simply re-adhere to another portion of the blind. Obviously this may consume a great deal of the overall cleaning time. Additionally, existing devices are normally intended to clean only one type of blind with a particular slat spacing, while a homeowner may have several types of blinds or shutters with varying slat spacing to clean.

The introduction of plastic for simulated wood blinds has aggravated the problem of dust accumulation owing to plastics tendency to hold a static charge. What is needed is a dust removal tool that provides a way for a nonprofessional to quickly and easily clean the blinds whether of traditional wood, vinyl and newer composites that will lift dust away from a slats surface without re-depositing the dust elsewhere on the slat.

SUMMARY OF THE INVENTION

The present invention proposes to solve the aforementioned problems by providing a frame and dusting finger configuration with the novel feature of dusting fingers that rotate about their axis while the frame is moved lengthwise down the slats of the venetian blinds, the result being more surface area of the dusting finger available for the retention of dust than the predecessors. This results in less frequent cleaning of the fingers and significantly reduces the amount of non-productive time for the cleaning process.

The present invention is optimized for cleaning blinds with either two inch or three inch slats by having dusting fingers rotatable about mounting pins that are repositionable, however it can effectively clean two, three, or four inch plantation shutters.

One object of the present invention is to provide an economical means to more thoroughly remove dust from venetian blinds of wood, metal and composite construction.

Another object of the present invention is to reduce the amount of un-productive time spent cleaning the fingers traditional dusters by providing more surface area for dust adherence.

Still another object of the present invention is to provide a dusting tool with removable dusting elements (fingers) that are easily laundered.

Yet another object of the present invention is to provide a dusting tool that is readily convertible to effectively clean both two inch and three inch slats.

Still another object of the present invention is to provide a dusting tool that effectively removes dust from two, three and four inch venetian blinds, vertical blinds, plantation shutters as well as ceiling fans.

BRIEF DESCRIPTION OF THE DRAWINGS

FIG. 4 is plan view of the dusting frame with repositionable pins spaced to accommodate wider spaced blinds and shutters;

FIG. 5 is a side view of the dusting frame with repositionable pin in place.

FIG. 6 is a cross sectional view of a dusting finger mounted on a repositionable pin.

DETAILED DESCRIPTION OF THE EMBODIMENTS

Figures 1, 2, 3:
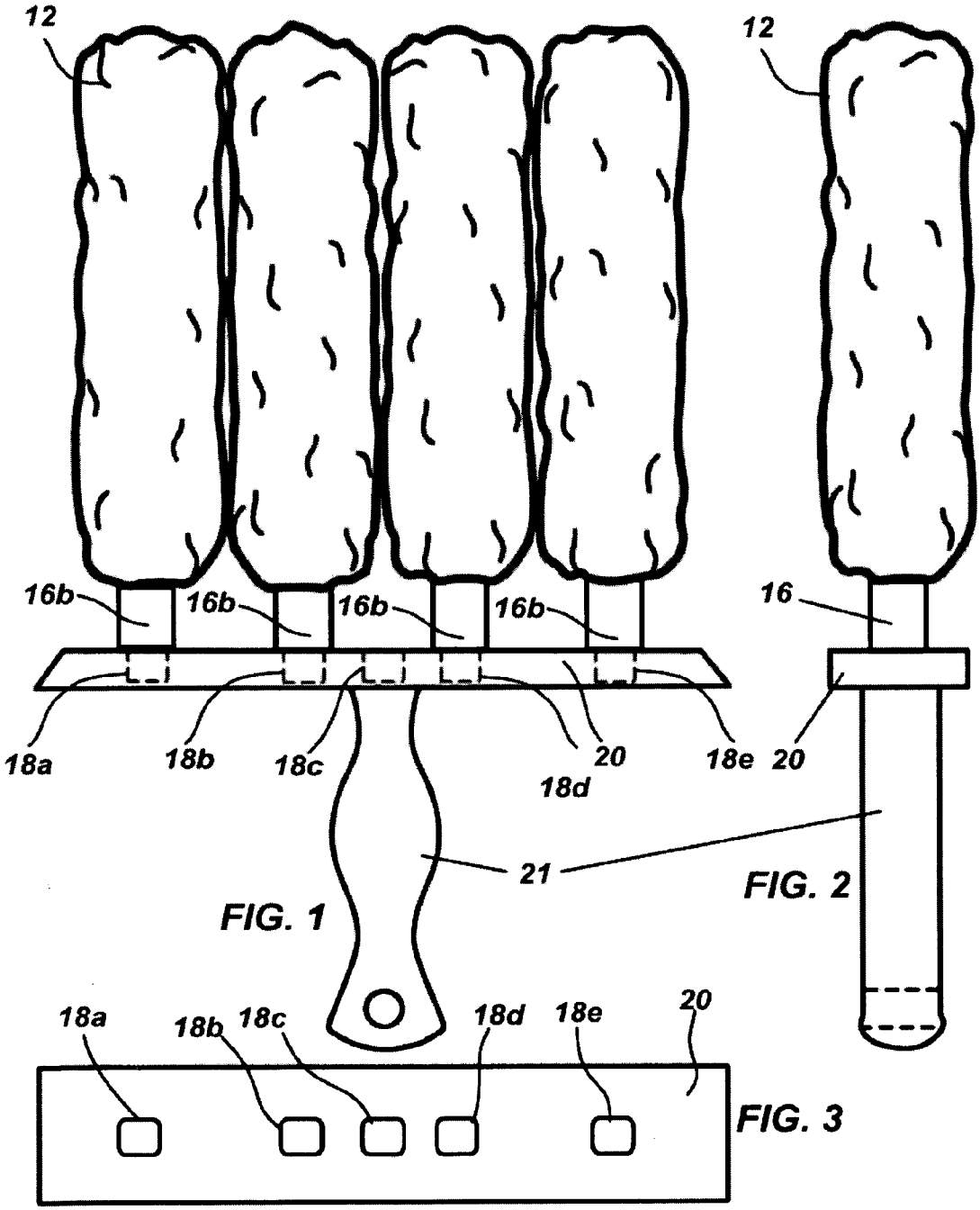
FIG. 1 is a plan view of the dusting frame showing the dusting fingers mounted on the repositionable pins.
FIG. 2 is an side view of the dusting frame showing dusting fingers mounted on the repositionable pins.
FIG. 3 is a top plan view of the cross member with formed recesses.

Referring to FIGS. 1-7; FIG. 1 is a plan view of a dusting frame having removable dusting fingers 12 positioned over a series of repositionable pins (FIG. 6) 16' each having a peg 16*a*, a collar 16*b* and a post 16*c* for insertion into an internal sleeve 14 of each dusting finger 12. The internal sleeve 14 is composed of a low friction material such as nylon and sized to fit over a post 16*c* with sufficient clearance allowing for the free rotational movement of the dusting fingers about each post of the repositionable pins. In FIG. 3, formed recesses 18*a*, 18*b*, 18*c*, 18*d* and 18*d* are placed along a length of a cross member 20 with handle 21. Each recess is shaped for the reception and mating therein of a peg 16*a*. While in the preferred embodiment the formed recesses have an opening that is rectangular in shape with filleted corners to prevent turning of the peg within the formed recesses and the pegs are secured into the formed recesses by a friction fit, as will be understood by one skilled in the art, other shapes for the recess openings and the mating pegs are possible and would prevent undesirable turning of the pegs within the recesses. The pegs may also be threaded and the formed recesses taped for a screw fit.

The frame as well as the repositionable pins may be constructed of wood, metal or injection molded thermoplastic such as ABS, polyamide, polypropylene, polyethylene, PVC or any suitably rigid material. While in the preferred embodiment the outer surface of the dusting fingers is natural lamb's wool, as will be understood by one skilled in the art, it may be of natural or synthetic wool, microfiber, felt, sponge, or any suitable material for the retention of dust particles.

Formed recesses 18*a*, 18*b*, 18*d* and 18*e* are equidistant to each other as are 18*a*, 18*c* and 18*e*. Centrally formed recess 18*c* allows a user to have a configuration of dusting fingers within recesses 18*a*, 18*c* and 18*e* to allow for the dusting of wider slat spacing, for example, 3 or 3½ inches as is the case with plantation shutters, while dusting fingers positioned at 18*a*, 18*b*, 18*d* and 18*e* permit the dusting of 2, 2½ or 4 inch spaced blinds or shutter slats. While the spacing natively available to the dusting frame allows for the dusting of a wide range of slat spacing using lamb's wool dusting fingers each having a maximum effective diameter of [ ], It should be understood that other pin spacing configurations may allow for the dusting of blinds and shutters with non standard slat spacing and other diameters of dusting fingers are not precluded. A single dusting finger at position 18*c* allows the user to dust the greatest range of blinds with varying slat spacing. Although the embodiment shown in FIGS. 1-2 has a number of dusting fingers, it is also conceivable that the device may be made with a shorted centered cross member for a single centrally positioned dusting member. FIG. 4 is a plan view of the device showing cross member 20 with an array of repositionable pins spaced for dusting a blind or shutter with 3" to 3½" slat width.

Figure 7:
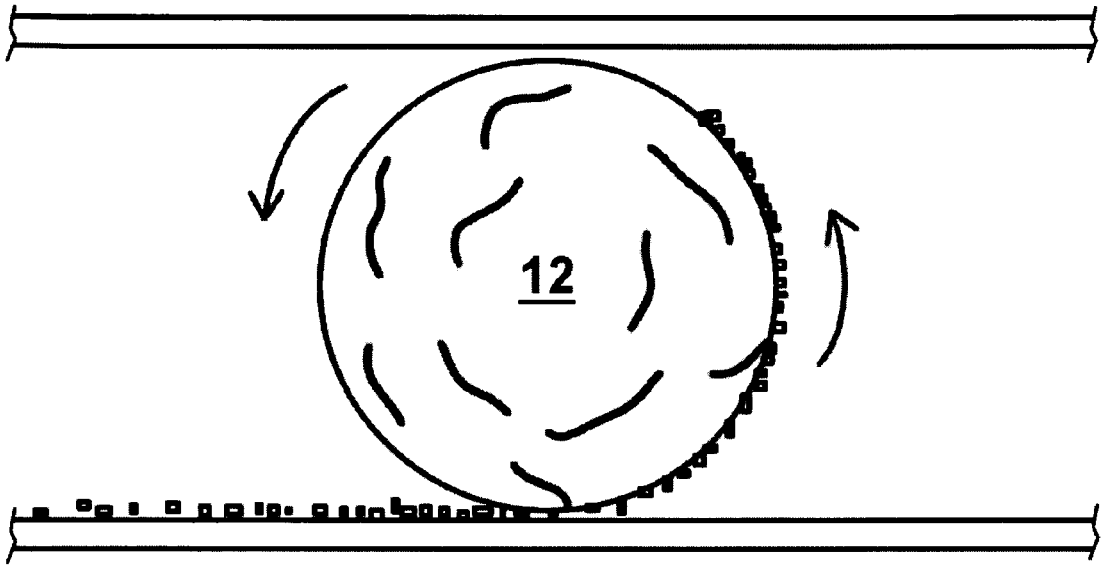
FIG. 7 shows a single dusting finger between two slats.

FIG. 7 shows an example of the rotational motion of each dusting finger as it rolls lengthwise along a blind slat. The rotational motion evenly captures dust particles without bunching or buildup leaving a clean blind behind.

The following are given as non limiting examples of the use of the present invention:

EXAMPLE 1

To Clean any Blind or Shutters Slats that are (2", 2½" or 4")

1) Place repositionable pins within recess positions 18*a*, 18*b*, 18*d*, 18*e;*
2) Place dusting fingers over pins;
3) Holding the handle with the dusting fingers parallel to the slats of the blind simply insert dusting fingers between slats at a slight angle (preferably 75-80 degrees) for ease;
4) Once fingers are inserted move dusting fingers horizontally across slats applying slight pressure for better cleaning;
5) After top of slats are clean, repeat processes for bottom of slats, allowing you to clean the bottom and top of the slats at the same time. As fingers move across slats fingers will rotate picking up dust with 360 degrees cleaning;
6) The dusting fingers may also be inserted between the cords and the slats of the blind to effectively clean all surfaces of slats.
7) Once slats are cleaned simply remove and re-insert on another section of blind until all slats are completely cleaned.

EXAMPLE 2

To Clean Shutters or Blinds that are (3 or 3½")

1) Place repositionable pins within recess positions 18*a*, 18*c*, 18*e;*
2) Hold duster with dusting fingers parallel to shutter slats and insert;
3) Move dusting fingers over all of slat surface both top and bottom. Repeat process for all slats until shutter slats are cleaned.

While the invention has been described by the embodiment given, it is not intended to limit the scope of the invention to the particular form set forth, but on the contrary, it is intended to cover such alternatives, modifications, and equivalents as may be included within the spirit and scope of the invention as defined by the appended claims.

I claim:

1. A dusting frame for the dusting of venetian blinds and plantation shutters comprising:

a handle member; and, a cross member having a plurality of recesses, the cross member connected in a 'T' configuration relative to the handle member; and, a plurality of dusting fingers each having a centered sleeve; and, a plurality of pins, each pin being repositionable to any of the recesses and each pin further comprising;

a peg insertable into each of the recesses; and, a collar resting above each of the recesses; and, a post insertable into the central sleeve of each of the dusting fingers and, the dusting fingers being freely rotatable about each of the pins and, the cross member in which each peg is restricted from turning within the shaped recess and, the dusting fingers covered in a dust attractant material selected from at least one of the following materials; natural, synthetic wool, microfiber, felt, sponge.

2. A duster for blind slats and plantation shutters comprising:

a plurality of repositionable pins in which the pins further comprise a peg portion, a collar portion and a post portion; and, a cross member having a plurality of recesses each recess shaped and sized for the removable insertion of each peg portion and supportive of the collar and post portions, and the recesses restrictive of the rotational movement of the pins; and, a handle attached to the cross member in a "T" configuration; and, a plurality of rotatable dust attracting fingers having a centered longitudinal sleeve, the dusting fingers being relatively cylindrical and having a substantially uninterrupted surface area contactable with a blind slat, and the dusting fingers sized to fit over each of the post portions, each dusting finger freely rotatable about each post portion as the duster is drawn lengthwise down the blind slats.

3. The duster according to claim 2 in which the dust attracting dusting fingers are covered in a material selected from at least one of the following; natural wool, synthetic wool, microfiber, felt, sponge.

* * * * *